US007740350B2

(12) United States Patent
Kessler

(10) Patent No.: US 7,740,350 B2
(45) Date of Patent: Jun. 22, 2010

(54) PRINTING APPARATUS

(75) Inventor: Kelly A. Kessler, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 611 days.

(21) Appl. No.: 11/154,071

(22) Filed: Jun. 15, 2005

(65) Prior Publication Data

US 2006/0284950 A1 Dec. 21, 2006

(51) Int. Cl.
*B41J 2/01* (2006.01)
*B41J 2/165* (2006.01)

(52) U.S. Cl. ..... 347/103; 347/33

(58) Field of Classification Search ..... 347/103, 347/101, 33

See application file for complete search history.

(56) References Cited

U.S. PATENT DOCUMENTS 3,477,568 A * 11/1969 Madrid ..... 209/127.3
4,210,080 A * 7/1980 Gundlach ..... 346/74.2
4,412,941 A * 11/1983 Probst et al. ..... 252/511
4,830,872 A * 5/1989 Grenfell ..... 427/472
4,910,556 A * 3/1990 Namiki ..... 399/286
5,221,828 A * 6/1993 Basheer et al. ..... 219/202
5,717,987 A * 2/1998 Fromm ..... 399/325
5,722,022 A * 2/1998 Park ..... 399/284
5,805,191 A * 9/1998 Jones et al. ..... 347/103
6,059,407 A * 5/2000 Komatsu et al. ..... 347/103
6,221,283 B1 * 4/2001 Dharmarajan et al. ..... 252/511
6,303,180 B1 * 10/2001 Bunyan et al. ..... 427/58
6,340,515 B1 1/2002 Sasagawa et al.
6,376,594 B1 4/2002 Sasagawa et al.
6,431,703 B2 * 8/2002 Rousseau et al. ..... 347/103
6,483,034 B1 11/2002 Sasagawa et al.
6,508,551 B1 * 1/2003 Snyder ..... 347/102
6,524,695 B2 2/2003 Sasagawa et al.
6,713,728 B1 3/2004 Justice et al.
6,921,064 B2 * 7/2005 Rousseau ..... 267/36.1
7,055,947 B2 * 6/2006 Silverbrook ..... 347/103
2002/0092849 A1 * 7/2002 Petrenko ..... 219/772
2003/0067528 A1 * 4/2003 Chowdry et al. ..... 347/103

* cited by examiner

*Primary Examiner*—Stephen D Meier
*Assistant Examiner*—Leonard S Liang
(74) *Attorney, Agent, or Firm*—Fay Sharpe LLP

(57) ABSTRACT

An imaging drum maintenance assembly that includes an oil applicator device, and an elastomeric metering blade spaced from the applicator roller and having a bulk resistivity that is less than about 500,000 ohm*meter.

20 Claims, 2 Drawing Sheets

PRINTING APPARATUS

BACKGROUND

The subject disclosure is generally directed to color printing.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

DETAILED DESCRIPTION

Figure 1:
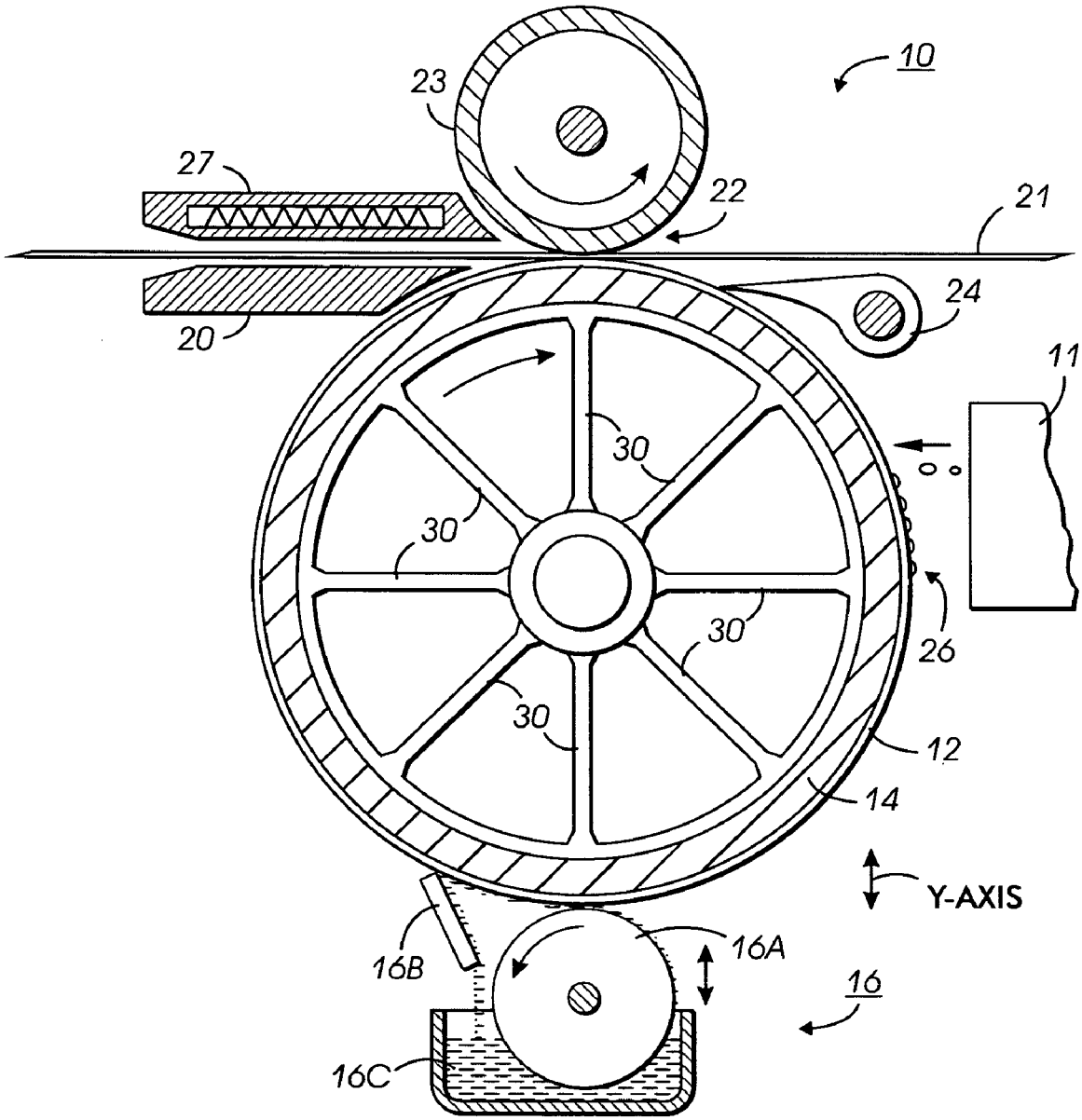
FIG. 1 is a schematic block diagram of an embodiment of a printing apparatus.

FIG. 1 is a schematic block diagram of an embodiment of a printing apparatus 10 in which the disclosed techniques can be employed. The printing apparatus includes a printhead 11 that is appropriately supported for moving utilization to emit drops 26 of ink onto an intermediate transfer surface 12 applied to a supporting surface of a print drum 14 that is rotatable about an axis of rotation that is parallel to an X-axis (FIG. 3) that is orthogonal to the plane of FIG. 1. The ink can be melted solid or phase change ink, for example, and the print drum 14 with webs 30 can be heated. The intermediate transfer surface 12 can comprise a functional oil that can be applied by contact with an oil applicator device such as an applicator roller 16A of an applicator assembly 16. By way of illustrative example, the applicator assembly 16 can include a housing 16C that supports the roller 16A and a metering blade 16B that is spaced from the roller 16A and meters the oil applied by the applicator roller. The housing 16C can function as a reservoir for containing oil that is removed from the print drum by the metering blade. The applicator assembly 16 can be configured for selective engagement with the print drum 14, and can be a consumable.

The metering blade 16B can comprise an elastomeric blade having a bulk resistivity that is less than about 500,000 ohm*meter, and can be attached to a bracket 18 made of a conductive material, for example with a conductive or non-conductive adhesive. By way of specific example, the metering blade 16B can comprise an elastomeric blade having a bulk resistivity that is less than about 300,000 ohm*meter. As another example, the metering blade 16B can comprise an elastomeric blade having a bulk resistivity that is less than about 150,000 ohm*meter. The metering blade can be electrically connected to ground. The applicator roller 16A can be a non-conductive roller, for example having a bulk resistivity that is greater than about $1\times10^{11}$ ohm*meter.

Figure 2:
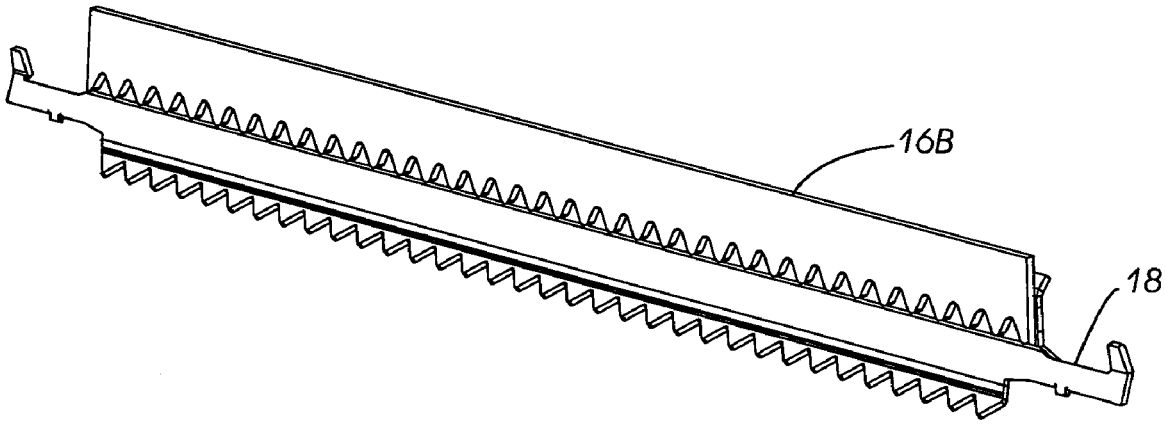
FIG. 2 is a schematic illustration of an embodiment of a metering blade assembly.

FIG. 2 is a schematic illustration of an embodiment of a metering blade assembly that includes a metering blade 16B adhesively attached to a bracket 18 that can be formed of a conductive material such as metal.

Referring again to FIG. 1, the printing apparatus 10 further includes a substrate guide 20 and a media preheater 27 that guides a print media substrate 21, such as paper, through a nip 22 formed between opposing acutated surfaces of a transfer roller 23 and the intermediate transfer surface 12 supported by the print drum 14. The transfer roller is selectively movable into contact with the intermediate transfer surface 12. Stripper fingers 24 can be pivotally mounted to assist in removing the print medium substrate 21 from the intermediate transfer surface 12 after an image 26 comprising deposited ink drops is transferred to the print medium substrate 21.

Figure 3:
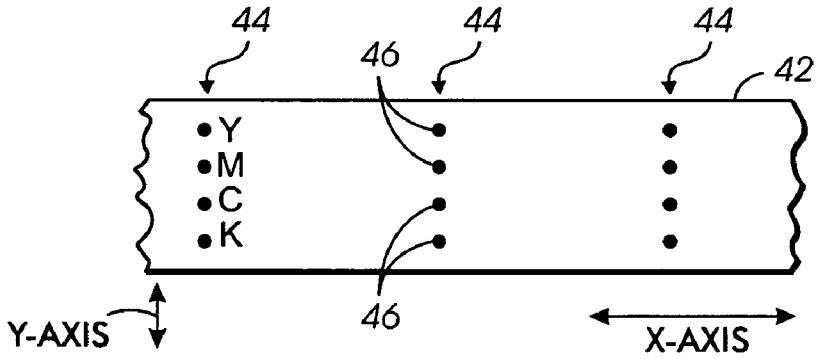
FIG. 3 is a schematic view of a portion of an embodiment of a face of an ink jet printhead of the printing of FIG. 1.

FIG. 3 schematically depicts an embodiment of a portion of a face of a printhead 11 having substantially mutually parallel columnar arrays 44 of nozzles 46 formed in a member 42. Each columnar array 44 can include a number of nozzles 46, for example one for each of primary colors such as cyan (C), magenta (M), yellow (Y), and black (K). The nozzles 46 in each columnar array 44 can be co-linear or slightly offset along the X-axis, for example. The columnar arrays 44 can be substantially parallel to a Y-axis which is orthogonal to the X-axis and in line or aligned with the rotation of the print drum 14. The ink drops deposited by each columnar array in a revolution of the print drum comprise a scan line. Each scan line can comprise drops from any of the nozzles that deposit a particular scan line. Each scan line is substantially parallel to the Y-axis.

Printing an image on the transfer surface 12 can be accomplished for example by rotating the print drum in a first direction (e.g., clockwise as viewed in FIG. 1), moving the applicator assembly into contact with the print drum to form the transfer surface, moving the applicator assembly away from the print drum after the transfer surface has been formed, depositing drops onto the transfer surface during a plurality of revolutions of the print drum, and appropriately translationally moving the printhead along the X-axis. For example, the printhead can be moved in increments (one for each print drum revolution, for example). Also, the printhead can be moved at a constant slew speed while the print drum rotates. In this manner, an image printed on the transfer surface 12 over a plurality of revolutions of the print drum comprises a plurality of interlaced scan lines.

An image can also be printed in a single pass or revolution of the print drum, in which case the X-axis dot density would be defined by the spacing between the columnar arrays of nozzles.

After an entire image is deposited onto the transfer surface 12, the deposited image is transferred to the print media substrate by moving the transfer roller into contact with the transfer surface 12 and moving the print media substrate 21 into the nip formed between the transfer roller and the intermediate transfer surface 12. Continued rotation of the print drum 14 causes the print media substrate to pass through the nip, and a combination of pressure in the nip and heat causes the deposited image to transfer from the print drum and fuse to the print media substrate 21. The transfer roller 23 is moved away from the print drum 14 after the image has been transferred.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging drum maintenance assembly comprising:

an oil applicator device;

an elastomeric conductive metering blade spaced from the oil applicator device and having a bulk resistivity that is less than about 500,000 ohm*meter and;

a conductive bracket composed of at least one serrated edge at which the metering blade is attached.

2. The imaging drum maintenance assembly of claim 1 wherein the oil applicator device has a bulk resistivity greater than about $1\times10^{11}$ ohm*meter.

3. The imaging drum maintenance assembly of claim 1 further including a bracket for supporting the elastomeric metering blade, and wherein the elastomeric metering blade is attached to the bracket with an adhesive.

4. The imaging drum maintenance assembly of claim 3 wherein the bracket is conductive.

5. The imaging drum maintenance assembly of claim 3 wherein the bracket is non-conductive.

6. The imaging drum maintenance assembly of claim 3 wherein the adhesive is conductive.

7. The imaging drum maintenance assembly of claim 3 wherein the adhesive is non-conductive.

8. The imaging drum maintenance assembly of claim 1 wherein the elastomeric metering blade is electrically connected to ground.

9. The imaging drum maintenance assembly of claim 1 wherein the oil applicator device and the elastomeric metering blade are part of a consumable.

10. An imaging drum maintenance assembly comprising:

an oil applicator device;

a conductive elastomeric metering blade having a bulk resistivity that is less than about 150,000 ohm*meter, spaced and not in contact with a non-conductive applicator roller having a bulk resistivity greater than about $1\times10^{11}$ ohm*meter; and a bracket comprised of a serrated edge of a series of adjacent equidistantly spaced jagged points arranged in a linear row and attached to the metering blade.

11. The imaging drum maintenance assembly of claim 10 wherein the oil applicator device has a bulk resistivity greater than about 1.times.10.sup.11 ohm*meter.

12. The imaging drum maintenance assembly of claim 10 further including a bracket for supporting the elastomeric metering blade, and wherein the elastomeric metering blade is attached to the bracket with an adhesive.

13. The imaging drum maintenance assembly of claim 12 wherein the bracket is conductive.

14. The imaging drum maintenance assembly of claim 12 wherein the bracket is non-conductive.

15. The imaging drum maintenance assembly of claim 12 wherein the adhesive is conductive.

16. The imaging drum maintenance assembly of claim 12 wherein the adhesive is non-conductive.

17. The imaging drum maintenance assembly of claim 10 wherein the elastomeric metering blade is electrically connected to ground.

18. The imaging drum maintenance assembly of claim 10 wherein the oil applicator device and the elastomeric metering blade are part of a consumable.

19. An imaging drum maintenance assembly comprising:

an oil applicator device;

a conductive grounded, consumable, elastomeric metering blade spaced from so as not to be in contact with the oil applicator device and having a bulk resistivity that is less than about 500,000 ohm*meter;

a conductive bracket for supporting the elastomeric metering blade, the bracket comprised of at least one series of adjacent, equidistantly spaced lagged points arranged in a linear row; and a print head for dispersing ink to the imaging drum prior to any action of the oil applicator device and the metering blade.

20. The imaging drum maintenance assembly of claim 19, wherein the print head comprises mutually parallel columnar arrays of nozzles for dispensing ink of colors cyan, magenta, yellow and black.

* * * * *